US006095171A

United States Patent [19]

Lin et al.

[11] Patent Number: 6,095,171

[45] Date of Patent: Aug. 1, 2000

[54] MULTIPLE-FOLD WINDPROOF UMBRELLA WITH COMPACT RESTORING MECHANISM

[75] Inventors: Chung-Kuang Lin, Taipei; Jung-Jen Chang, Taipei Hsien, both of Taiwan

[73] Assignee: Fu Tai Umbrella Works, Ltd., Taipei Hsien, Taiwan

[21] Appl. No.: 09/197,482

[22] Filed: Nov. 20, 1998

[51] Int. Cl.[7] ..... A45B 25/26

[52] U.S. Cl. ..... 135/33.7; 135/29; 135/32; 135/25.32; 403/85

[58] Field of Search ..... 135/25.1, 25.31, 135/25.32, 29, 31, 32, 33.2, 33.7, 98; 403/85

[56] References Cited

U.S. PATENT DOCUMENTS

| | | | |
|---|---|---|---|
| 212,457 | 2/1879 | Girbardt | 135/33.7 |
| 1,027,426 | 5/1912 | McClellan | 135/32 |
| 3,456,661 | 7/1969 | Farley | 135/33.7 |
| 3,960,162 | 6/1976 | Noel | 135/33.7 |
| 4,007,752 | 2/1977 | Weber | 135/25.31 |
| 4,865,063 | 9/1989 | Williams | 135/33.7 |
| 4,979,534 | 12/1990 | Johnson et al. | 135/33.7 |
| 5,078,166 | 1/1992 | Lee | 135/33.7 |
| 5,115,827 | 5/1992 | Lee | 135/33.7 |
| 5,601,103 | 2/1997 | Dubinsky | 135/33.7 |
| 5,640,984 | 6/1997 | Dubunsky | 135/33.7 |
| 5,890,506 | 4/1999 | Kupferman | 135/33.2 |

*Primary Examiner*—Carl D. Friedman
*Assistant Examiner*—Winnie Yip

[57] ABSTRACT

A multiple-fold windproof umbrella includes: a central shaft having a rib assembly pivotally secured to the central shaft, a lower cloth secured to the rib assembly, an upper cloth secured to the central shaft and juxtapositionally retained above the lower cloth, and a plurality of control valves each formed between the upper cloth and the lower cloth secured on the rib assembly and openable for escaping a strong wind blowing into the umbrella cloths; and for automatically restoring the upper cloth downwardly for closing the opening between the upper and lower cloths of the umbrella after the escape of wind.

6 Claims, 7 Drawing Sheets

41
432
4
441
441a
42
431
43
44
24

A
40
432
41
441a
43
23
442
42
24
431
44
4

41
43
4
441
44
23
442
42

430
44
24
A
40
41
442
43
23
24
44
42
44

23

13
51
5
52

31a
3a
32a
31
2
32
3
1
11
5
5
3a
0
2
A
3
4
1

3a
5
3
1

3
23
44
5
52
O
44
5
31
43
24
41
25
30
2
21
51
13
11
22
12
1
32
3
44
3
23
5
242
43
31
24
41
4
241
40
42
243
22
25

44
3
23
5
43
242
31
24
41
42
40
241
243
22
25

MULTIPLE-FOLD WINDPROOF UMBRELLA WITH COMPACT RESTORING MECHANISM

BACKGROUND OF THE INVENTION

A conventional umbrella with a wind escape (10*a*) as illustrated in FIG. 18 was granted to Wen P. Lee as U.S. Pat. No. 5,078,166, which includes a collapsible frame structure (14*a*) in which each upper rib (30*a*) is segmented into three pivotal members (50, 52 and 54) in which the inner member (50) is pivotally affixed at its inner end (32*a*) to the inside cap (26) to support the upper canopy (16). Each stretcher (34*a*) is radically pivotally affixed at its inner end (36*a*) to the runner (28), is pivotally affixed at its center (56) to the inner member (50) of the upper rib (30*a*) and is pivotally affixed at its outer end (38*a*) to the outer member (54) of the upper rib (30*a*). Each lower rib (40*a*) is pivotally affixed at its inner end (42*a*) to the middle member (52) of the upper rib (30*a*) and at pivotal portion (58) to the stretcher (34*a*) to support the lower canopy (18) to keep the wind escape opening (12) formed therebetween.

However, this conventional umbrella has the following drawbacks:

1. The rib assembly includes two sets of parallelogram linkage among the ribs (52, 50, 34*a*, 40*a*, 54) to increase the production complexity and cost.
2. The wind escape opening (12) is so large to easily direct rain water inwardly to wet the umbrella user through the opening (12). The opening (12) can not be minimized due to the volume as occupied by the plural pivotal joints such as at numerals 42*a*, 58, 38*a*.
3. There is not provided with any automatic restoring mechanism to restore the upper rib members to close the opening whenever the wind has escaped. The strong wind may still invert the upper ribs and upper canopy upwardly, requiring a manual downward restoring of the upwardly inverted ribs and canopy.

The present inventor has found the drawbacks of the conventional windproof umbrella and invented the present multiple-fold windproof umbrella with compact restoring mechanism.

SUMMARY OF THE INVENTION

The object of the present invention is to provide a multiple-fold windproof umbrella including: a central shaft having a rib assembly pivotally secured to the central shaft, a lower cloth secured to the rib assembly, an upper cloth secured to the central shaft and juxtapositionally retained above the lower cloth, and a plurality of control valves each formed between the upper cloth and the lower cloth secured on the rib assembly and openable for escaping a strong wind blowing into the umbrella cloths; and for automatically restoring the upper cloth downwardly for closing the opening between the upper and lower cloths of the umbrella after the escape of wind.

DETAILED DESCRIPTION

Figures 1, 2, 3:
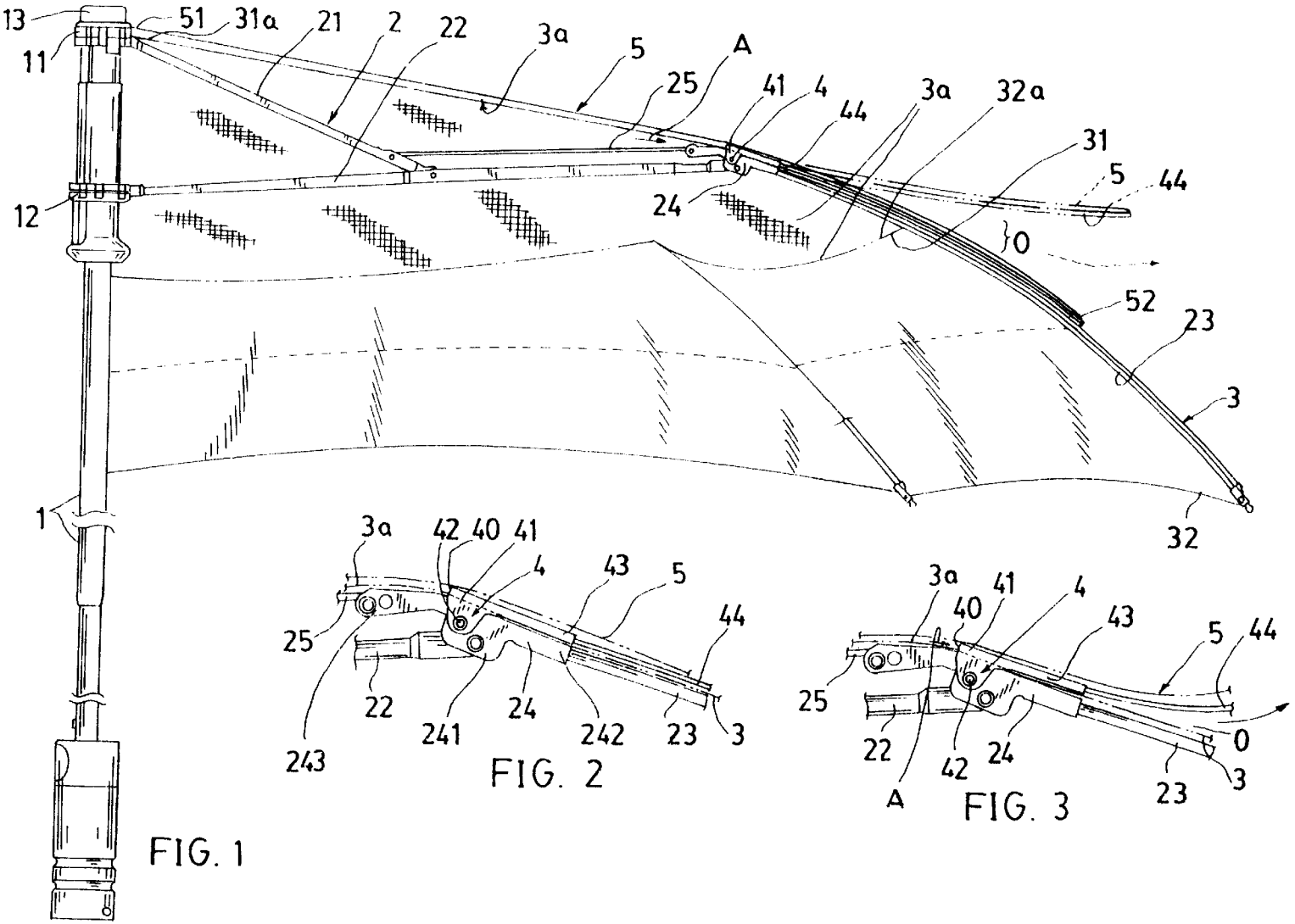
FIG. 1 is an illustration showing an opened umbrella of the present invention.
FIG. 2 shows a closed control valve of the present invention.
FIG. 3 shows an opened control valve of the present invention.
Figure 4:
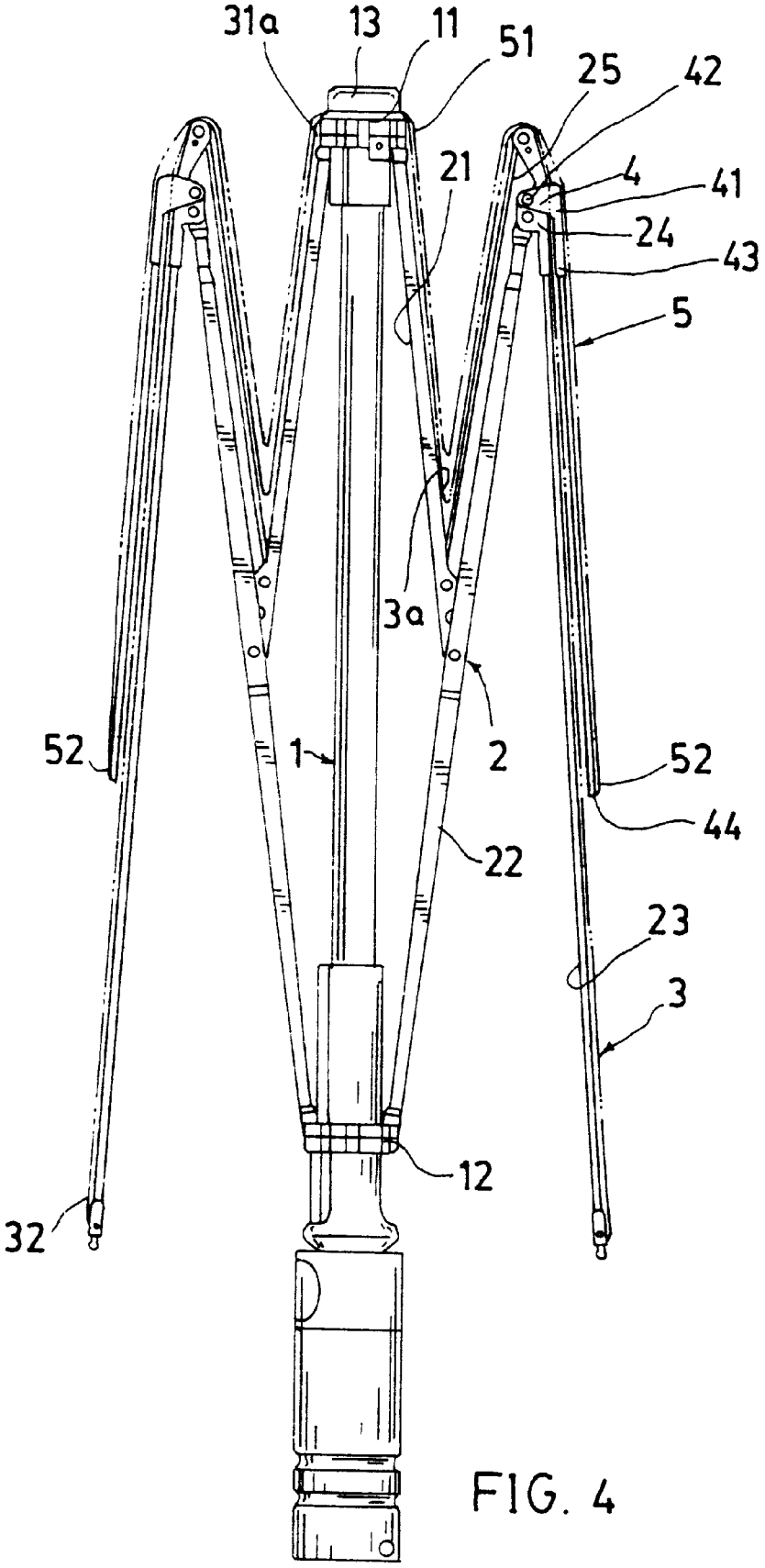
FIG. 4 shows a folded umbrella of the present invention.

As shown in FIGS. 1~11, a multiple-fold windproof umbrella of the present invention comprises: a central shaft 1, a rib assembly 2 pivotally secured to the central shaft 1, a lower cloth 3 secured to the rib assembly 2, a net member 3*a* secured to the central shaft 1 and secured with the lower cloth 3, a plurality of control valves 4 each formed or secured on the rib assembly 2, and an upper cloth 5 secured to the central shaft 1 and secured on each control valve 4 which controls the opening or closing of an opening O formed by a wind blowing through an aperture between the upper and lower cloths 5, 3.

The multiple-fold umbrella of the present invention may be two folds as illustrated or may be other multiple folds as modified from the present invention. The rib assembly 2 includes a plurality of ribs pivotally connected with one another for securing the umbrella cloth thereon. The rib assembly 2 as shown in FIG. 1 is a preferred embodiment of the present invention, but not limited to the example as illustrated in the drawings accompanied herewith. The umbrella may be an automatic umbrella or may be a manually operated umbrella, also not limited in the present invention.

The rib assembly 2 includes: a top rib 21 pivotally secured to an upper notch 11 of the central shaft 1, a stretcher rib 22 pivotally secured to a lower runner 12 slidably held on the central shaft 1 and also secured with an outer portion of the top rib 21, and an outer rib 23 secured to a joint member 24 which is pivotally secured to an outer portion of the stretcher rib 22 and also pivotally secured to the top rib 21 through a connecting rib 25.

The lower cloth 3 has an upper peripheral portion 31 secured to the rib assembly especially secured on the outer rib 23, and a lower peripheral portion 32. The upper peripheral portion 31 may also be secured on the joint member 24 of the rib assembly 2.

The net member 3*a* has a central portion 31*a* secured to the upper notch 11 of the central shaft 1, and an outer peripheral portion 32*a* connected with the upper peripheral portion 31 of the lower cloth 3. The net member 3*a* includes a plurality of meshes defined in the net member 3*a* allowing the escape of wind when blown into the canopy of the umbrella cloths 3, 5.

The upper cloth 5 has a central portion 51 secured to the upper notch 11 and retained on the notch 11 by a cap 13 fixed on a top end of the central shaft 1, and an outer peripheral portion 52 secured to the control valve 4.

Each joint member 24 of the rib assembly 2 includes a lug portion 241 for pivotally connecting an outer portion of the stretcher rib 22, an outer portion 242 for connecting the outer rib 23, and an inner portion 243 for connecting an outer portion of the connecting rib 25, of which the inner portion is connected to the top rib 21.

Each control valve 4 includes: a base portion 41 connected to the joint member 24 by a pivot 42 (or an eyelet or other joining means); an air inlet port 40 defined between the base portion 41 and the joint member 24 for directing wind or air outwardly through an escape opening O defined between the upper cloth 5 and the lower cloth 3 as shown in FIGS. 3, 1; a sleeve portion 43 protruding outwardly from the base portion 41 having a socket 431 recessed in the sleeve portion 43 and a notch 432 cut out in the sleeve portion 43; and a restoring spring member 44 having an inner end 441 formed with a protrusion 441*a* thereon to be engaged with the notch 432 in the sleeve portion 43 (FIGS. 5, 6) when the inner end 441 of the spring member 44 is inserted into the socket 431 recessed in the sleeve portion 43, and an outer end 442 having perforations formed in the spring member 44 to be connected with the outer peripheral portion 52 of the upper cloth 5 such as by stitching or sewing.

Figure 17:
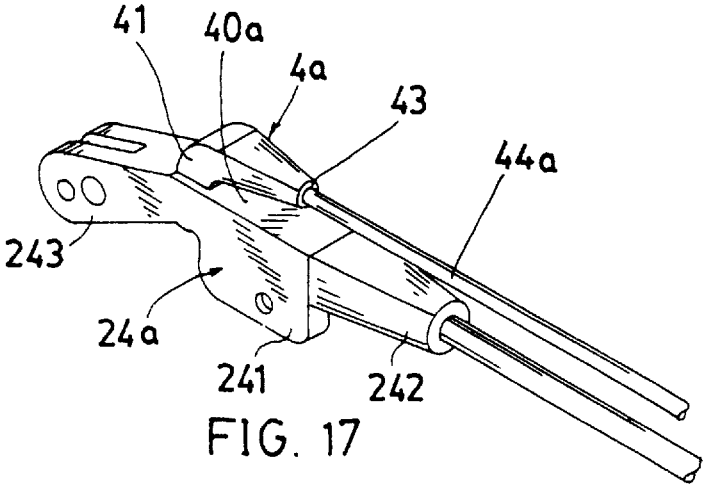
FIG. 17 shows another preferred embodiment of the present invention as modified from FIG. 16.
Figure 18:
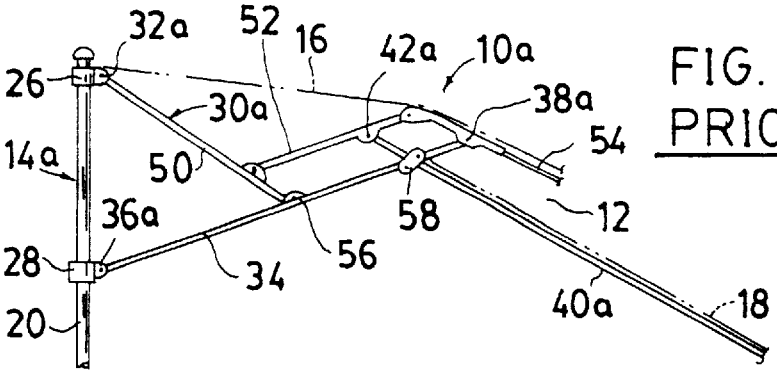
FIG. 18 PRIOR ART
FIG. 18 shows a conventional windproof umbrella.

The restoring spring member 44 may be an elongate spring plate as illustrated or may be a spring rod (FIG. 17).

Figures 5, 6, 7, 8:
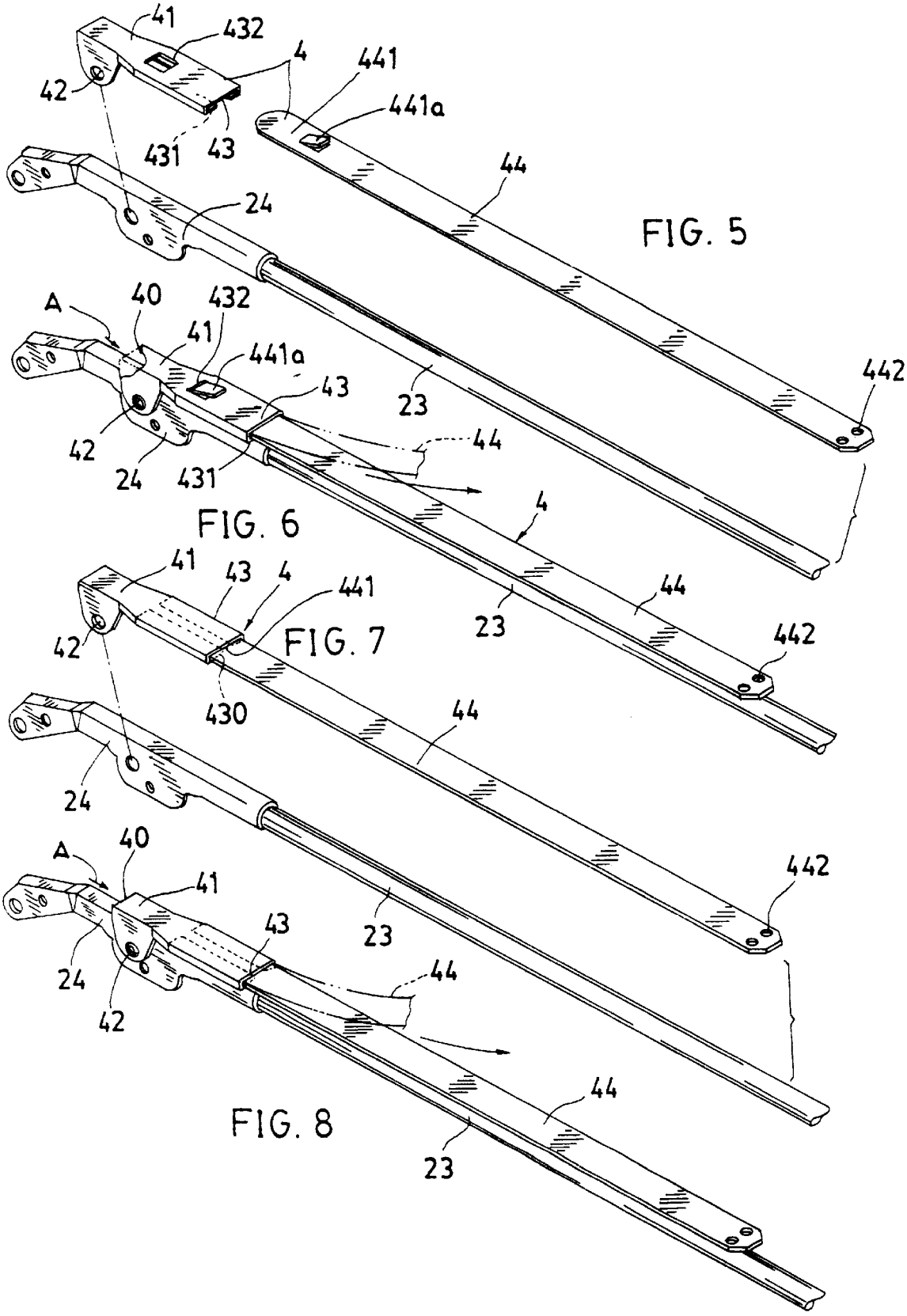
FIG. 5 is an exploded view of the control valve and a joint member of the present invention.
FIG. 6 is a perspective view as assembled from FIG. 5.
FIG. 7 shows another preferred control valve and joint member as modified from FIG. 5.
FIG. 8 shows an assembled structure from FIG. 7.
Figures 9, 10, 11:
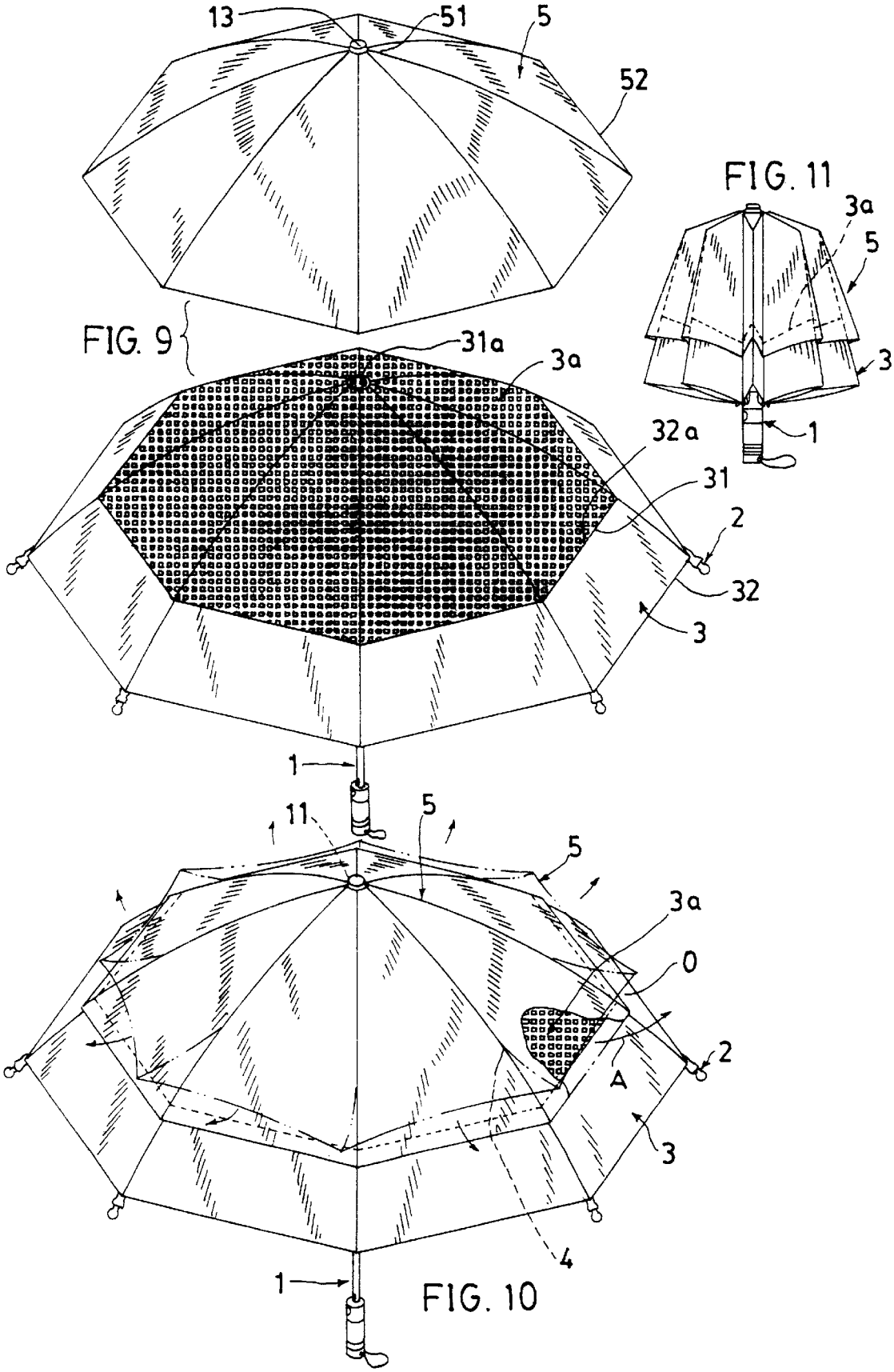
FIG. 9 is a perspective view of the present invention when the upper cloth is separated from the umbrella.
FIG. 10 is a perspective view when assembled from FIG. 9.
FIG. 11 shows a folded umbrella from FIG. 10.

The sleeve portion 43 of the control valve 4 may be formed as a pair of crimped edge portions 430 for firmly clamping an inner end 441 of the spring member 44 as shown in FIGS. 7, 8.

When an opened umbrella of the present invention is subjected to a strong wind, the air A will blow through the inlet port 40 to open control valve 4 to open the opening O between the upper and lower cloths 5, 3 as shown in FIGS. 1, 3, 6, 8 and 10 to be escaped therefrom. The sleeve portion 43 and the spring member 44 of the control valve 4 will be biased upwardly to open the opening O defined between the upper and lower cloths 5, 3. After the wind is escaped, the resilience of the spring member 44 will be automatically restored to close the upper cloth 5 on the lower cloth 3 as solid line shown in FIGS. 1, 2 and 10.

The present invention is superior to the conventional windproof umbrella, such as the prior art of U.S. Pat. No. 5,078,166, with the following advantages:

1. The control valve 4 provides an automatic restoring mechanism, which is compact and simple, just formed as an elongate spring plate (or rod), for automatically restoring the umbrella upper cloth and ribs for closing the aperture between the upper and lower cloths without inversion of the ribs and upper cloth.
2. The net member 3*a* provides a uniform stress distribution on the net member 3*a* and on the lower cloth 3 secured to the net member 3*a* for a stable tensioning of the umbrella cloth and ribs 2 when opening the umbrella. The meshes in the net member 3*a* may dampen the wind force due to friction loss of air streamflow impacting the meshes, fibrous strings, wires in construction of the net member 3*a* to weaken the wind force striking on the umbrella cloth 5 in order to prolong the service life of the umbrella.
3. The control valve 4 is not a complex linkage of ribs and is just a simple structure for controlling the opening or closing of the opening O between the upper and lower cloths 5, 3 for a simpler production and lower cost therefor.
4. The control valve 4 and the upper cloth 5 can be as close as possible to be approximately juxtapositioned above the joint member 24 of the rib assembly 2 and the lower cloth 3, and the "wind discharge passage" from a tiny inlet port 40 towards the opening O between the upper and lower cloths 5, 3 is gradually enlarged outwardly so as to prevent from intrusion of rainy water droplets into the "interior" under a "canopy" formed by the upper and lower cloths 5, 3, thereby preventing wetting to the umbrella user.

The present invention may be further modified to omit the net member 3*a* as aforementioned.

Figures 12, 13, 14:
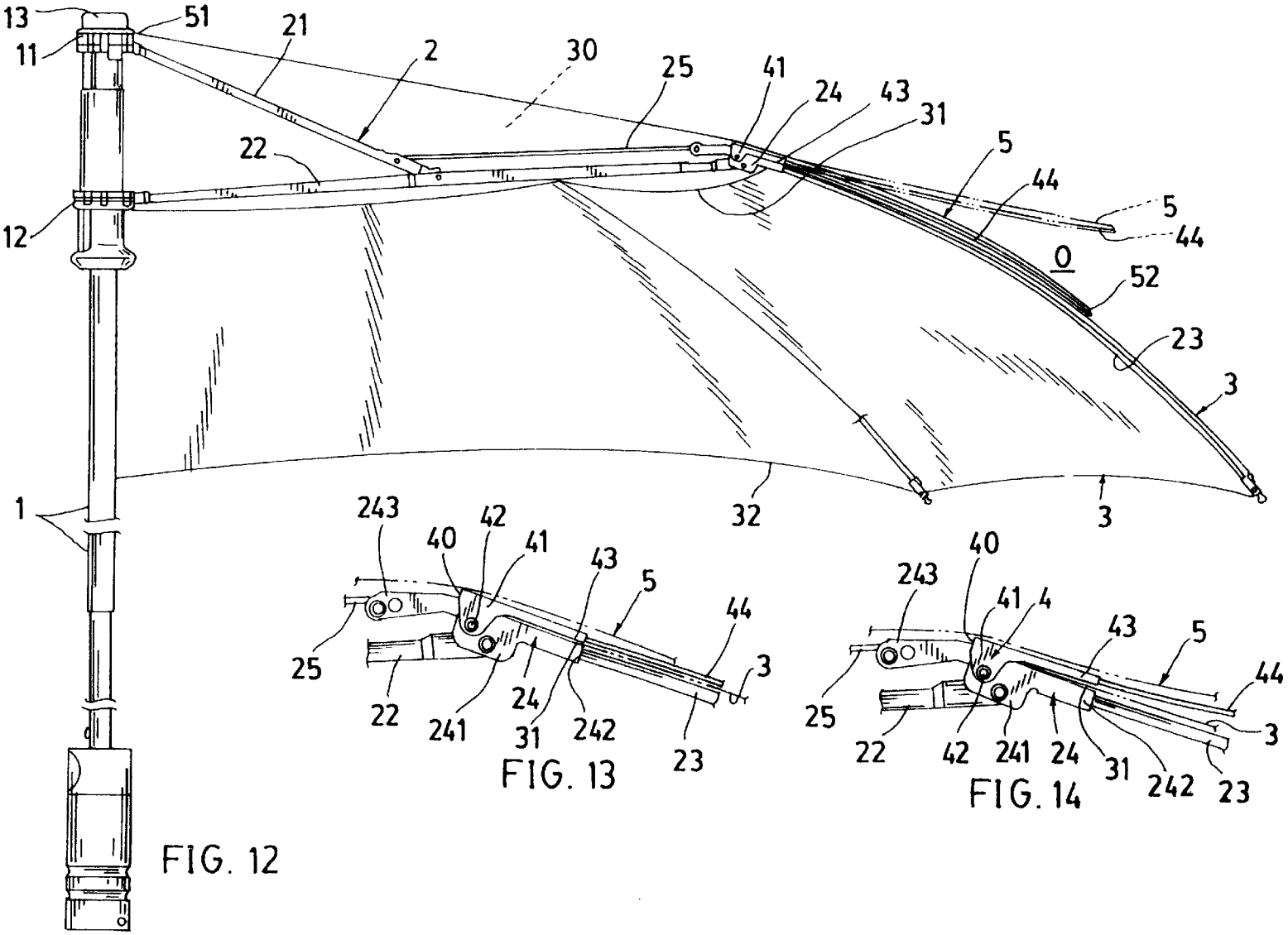
FIG. 12 shows an opened umbrella of another preferred embodiment of the present invention.
FIG. 13 shows a closed control valve of FIG. 12.
FIG. 14 shows an opened control valve openable from FIG. 13.
Figure 15:
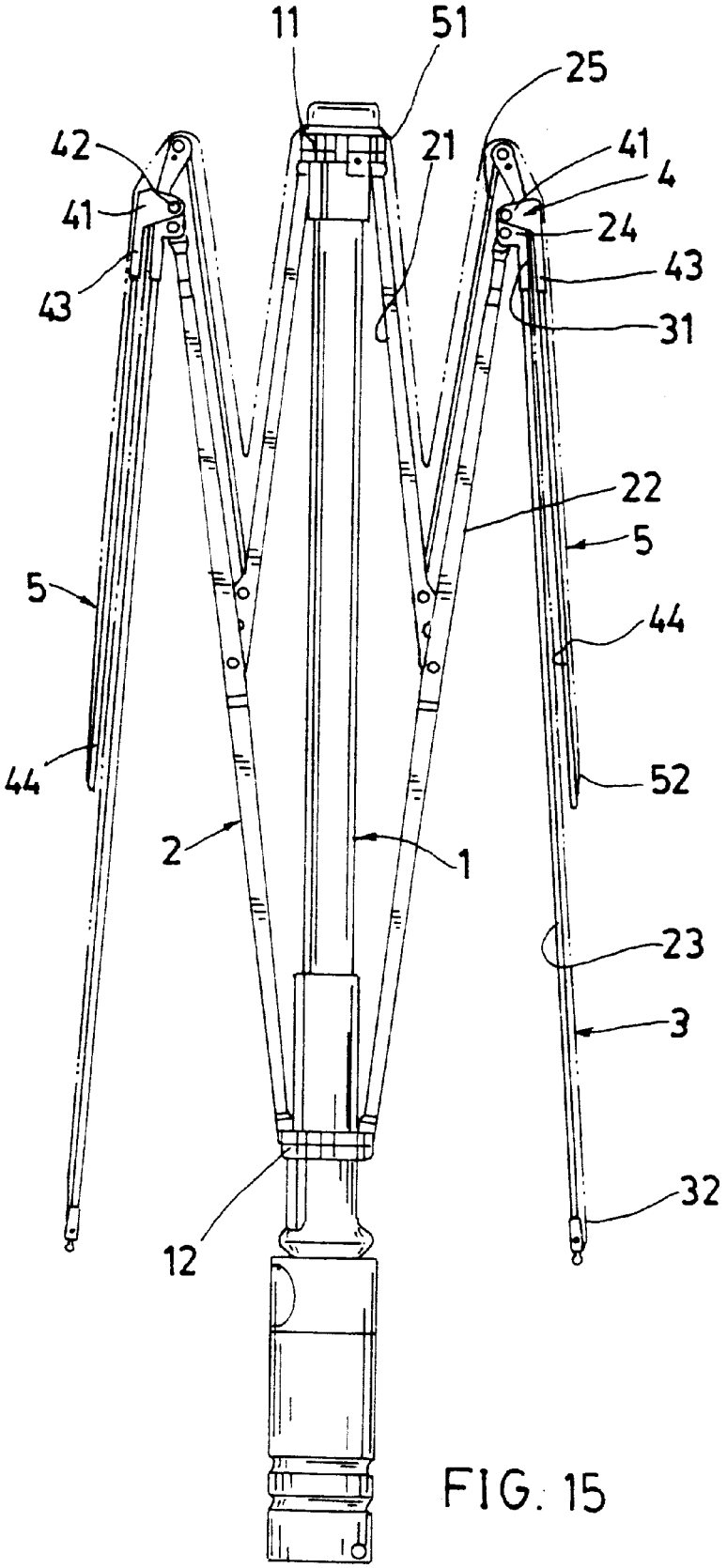
FIG. 15 shows a folded umbrella from FIG. 12.

The lower cloth 3 has its upper peripheral portion 31 secured on the joint member 24, thereby forming a big central opening 30 between the lower cloth 3 and the upper notch 11 of the shaft 1 as shown in FIG. 12. This modification may simplify the structure of the present invention to lower the production cost accordingly.

Figure 16:
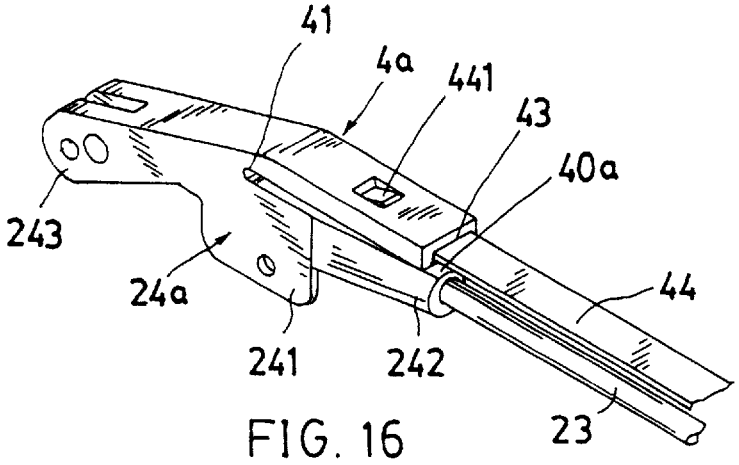
FIG. 16 is a perspective view of another preferred embodiment of the control valve integrally formed on the joint member of the present invention.

The control valve 4*a* may also be modified as shown in FIGS. 16, 17 to be integrally formed on/with the joint member 24*a* by plastic molding process or other integral forming processes.

The control valve 4*a* has its base portion 41 integrally formed on the joint member 24*a* to define an air inlet passage 40*a* between a sleeve portion 43 and the joint member 24*a* to allow an escape of the wind therethrough. The sleeve portion 43 may be formed as a socket (FIG. 16) for inserting the inner end of the spring plate 44; or formed as a tubular sleeve portion (FIG. 17) for inserting a spring rod (44*a*) having a cross section of circular shape.

The present invention may be further modified without departing from the spirit and scope of the present invention.

What is claimed is:

1. A multiple-fold windproof umbrella comprising:

a central shaft;

a rib assembly pivotally secured to an upper notch formed on a top portion of the central shaft and a lower runner slidably held on the central shaft;

a lower cloth secured on the rib assembly and connected with a net member which is secured to the upper notch of the central shaft;

an upper cloth secured to the upper notch of the central shaft and juxtapositioned above said lower cloth and said net member; and a plurality of control valves each control valve formed between the upper cloth and said rib assembly to define an air passage between said upper cloth and said lower cloth secured on said rib assembly;

said control valve normally resiliently restoring said upper cloth to approximate said lower cloth to close an opening defined between said upper cloth and said lower cloth;

each said control valve including a base portion secured to a joint member which is provided for pivotally connecting an outer rib to an inner portion of the rib assembly, an air inlet port defined between the joint member and the base portion for directing air of a strong wind therein, a sleeve portion protruding outwardly from the base portion, and a restoring spring member fixed in the sleeve portion for securing a lower portion of the upper cloth on the spring member for resiliently restoring said upper cloth to approximate said lower cloth; whereby upon blowing of the strong wind, said sleeve portion and said spring member is biased upwardly to open said opening defined between said upper and lower cloths to discharge air from said air inlet port and through said opening for escaping the wind; and upon escape of the wind, the spring member and the upper cloth will be resiliently restored downwardly to close the opening between said upper and lower cloths;

the improvement which comprises:

(a) said restoring spring member being an elongate spring plate having an inner end thereof fixed in the sleeve portion of said control valve, and having an outer end of said spring member connected with an outer peripheral portion of said upper cloth; and (b) said net member having meshes for dampening the wind force due to friction loss of air streamflow impacting the meshes in construction of said net member.

2. A multiple-fold windproof umbrella according to claim 1, wherein said joint member includes a lug portion for pivotally connecting a stretcher rib of the rib assembly, an outer portion of the joint member connected with the outer rib, and an inner portion of the joint member for securing a connecting rib which is connected to a top rib pivotally connected between the upper notch and the stretcher rib pivotally connected to the lower runner; and said joint member connected to said base portion of said control valve.

3. A multiple-fold windproof umbrella according to claim 1, wherein said control valve is integrally formed on said joint member.

4. A multiple-fold windproof umbrella according to claim 1, wherein said control valve is pivotally secured to said joint member.

5. A multiple-fold windproof umbrella according to claim 1, wherein said spring plate has a protrusion formed on the inner end of the spring plate to be engaged with a notch cut out in the sleeve portion of the control valve.

6. A multiple-fold windproof umbrella comprising:

a central shaft;

a rib assembly pivotally secured to an upper notch formed on a top portion of the central shaft and a lower runner slidably held on the central shaft;

a lower cloth secured on the rib assembly and connected with a net member which is secured to the upper notch of the central shaft;

an upper cloth secured to the upper notch of the central shaft and juxtapositioned above said lower cloth and said net member; and a plurality of control valves each control valve formed between the upper cloth and said rib assembly to define an air passage between said upper cloth and said lower cloth secured on said rib assembly;

said control valve normally resiliently restoring said upper cloth to approximate said lower cloth to close an opening defined between said upper cloth and said lower cloth;

each said control valve including a base portion secured to a joint member which is provided for pivotally connecting an outer rib to an inner portion of the rib assembly, an air inlet port defined between the joint member and the base portion for directing air of a strong wind therein, a sleeve portion protruding outwardly from the base portion, and a restoring spring member fixed in the sleeve portion for securing a lower portion of the upper cloth on the spring member for resiliently restoring said upper cloth to approximate said lower cloth; whereby upon blowing of the strong wind, said sleeve portion and said spring member is biased upwardly to open said opening defined between said upper and lower cloths to discharge air from said air inlet port and through said opening for escaping the wind; and upon escape of the wind, the spring member and the upper cloth will be resiliently restored downwardly to close the opening between said upper and lower cloths;

the improvement which comprises:

said restoring spring member being an elongate spring plate having an inner end thereof fixed in the sleeve portion of said control valve, and having an outer end of said spring member connected with an outer peripheral portion of said upper cloth.

* * * * *